US005294266A

United States Patent [19]

Hauffe et al.

[11] Patent Number: 5,294,266

[45] Date of Patent: Mar. 15, 1994

[54] PROCESS FOR A PASSIVATING POSTRINSING OF CONVERSION LAYERS

[75] Inventors: Dieter Hauffe, Frankfurt am Main; Thomas Kolberg, Heppenheim; Gerhard Müller, Hanau am Main; Horst Gehmecker, Gross-Gerau; Werner Rausch, Oberursel; Peter Schubach, Schöneck-Oberdorfelden; Thomas Wendel, Bad Homburg, all of Fed. Rep. of Germany

[73] Assignee: Metallgesellschaft Aktiengesellschaft, Frankfurt am Main, Fed. Rep. of Germany

[21] Appl. No.: 978,193

[22] Filed: Nov. 18, 1992

Related U.S. Application Data

[63] Continuation of Ser. No. 645,159, Jan. 24, 1991, abandoned, which is a continuation-in-part of Ser. No. 484,730, Feb. 23, 1990, abandoned.

[30] Foreign Application Priority Data

Jul. 28, 1989 [DE] Fed. Rep. of Germany ..... 3924984
May 29, 1990 [DE] Fed. Rep. of Germany ..... 4017186
May 29, 1990 [DE] Fed. Rep. of Germany ..... 4017187

[51] Int. Cl.[5] ..... C23C 22/83

[52] U.S. Cl. ..... 148/247; 148/243; 148/255; 148/256; 148/257; 205/194; 205/197

[58] Field of Search ..... 148/243, 247, 255, 256, 148/257; 205/194, 197

[56] References Cited

U.S. PATENT DOCUMENTS

| | | | |
|---|---|---|---|
| 3,501,352 | 3/1970 | Shah | 148/62 |
| 3,695,942 | 10/1972 | Binns | 148/6.15 R |
| 3,850,732 | 11/1974 | Binns | 204/181 |
| 3,852,123 | 12/1974 | Goltz | 148/6.14 |
| 3,895,970 | 7/1975 | Blum et al. | 148/6.15 R |
| 3,912,548 | 10/1975 | Faigen | 148/6.15 R |
| 3,966,502 | 6/1976 | Binns | 148/6 |
| 4,376,000 | 3/1983 | Lindert | 148/6.15 R |
| 4,496,404 | 1/1985 | King | 148/6.14 R |
| 4,617,068 | 10/1986 | King | 148/6.14 R |
| 4,650,256 | 3/1987 | Wetzinger | 299/92 |
| 4,650,526 | 3/1987 | Claffey et al. | 148/6.14 R |

FOREIGN PATENT DOCUMENTS

| | | | |
|---|---|---|---|
| 0153973 | 9/1985 | European Pat. Off. | C23C 22/34 |
| 0161667 | 11/1985 | European Pat. Off. | C23G 1/08 |
| 3434359 | 9/1984 | Fed. Rep. of Germany | E21C 25/44 |
| 684954 | 8/1966 | France . | |
| 2117256 | 6/1972 | France | C23G 1/00 |
| 2207199 | 6/1974 | France | C23F 7/00 |
| 2232615 | 1/1975 | France | C23F 7/08 |
| 2236907 | 2/1975 | France | C09D 3/48 |

OTHER PUBLICATIONS

F. A. Lowenheim, *Electroplating*, McGraw-Hill Book Co., New York, 1978, p. 442.

"Coating of Metals with Silianes", Nihon Parkerizing Co., Ltd., Jpn. Tokkyo Koho JP 59 64,781, Apr. 12, 1984, (Japanese counterpart of EP 153 973) (Abstract English translation).

*Primary Examiner*—John Niebling
*Assistant Examiner*—William T. Leader
*Attorney, Agent, or Firm*—Felfe & Lynch

[57] ABSTRACT

The invention is in a composition and process for the chromium free passivating postrinsing of conversion layers on metals before the application of a paint or adhesive. The conversion layers can be on the bases of phosphate layers, at least two polyvalent metal ions with complex formers, titanium, zirconium and/or hafnium. The postrinsing agent is an aqueous solution which has been adjusted to a pH value of up to 5 and which contains an aluminum fluorozirconate having an Al:Zr:F mole ratio of (0.15 to 8.0):1:(5 to 52), and in which solutions the total concentration of Al+Zr+F is 0.1 to 8.0 g/l. The postrinsing solutions may additionally contain at least one of the anions benzoate, caprylate, ethyl hexoate, salicylate in a total concentration of 0.05 to 0.5 g/l and may preferably be adjusted to the required pH value with cations of volatile bases, such as ammonium, ethanolammonium and di- and triethanolammonium. The paint is subsequently applied suitably by cathodic electrocoating or powder coating or from a low-solvent high-solids paint.

The rinsing treatment is over a period of 1 to 120 seconds at temperatures of 20° to 80° C. The invention is used as a pretreatment to the application of a paint coating, film coating or adhesive coating.

18 Claims, No Drawings

PROCESS FOR A PASSIVATING POSTRINSING OF CONVERSION LAYERS

This application is a continuation of application Ser. No. 07/645,159, filed Jan. 24, 1991, now abandoned; which is a continuation-in-part of application Ser. No. 07/484,730, filed Feb. 23, 1990, now abandoned.

BACKGROUND OF INVENTION

This is a continuation-in-part of application Ser. No. 484,730, filed Feb. 23, 1990.

The present invention relates to passivating postrinsing of conversion layers on metals, particularly steel, galvanized steel, zinc alloy-plated steel and aluminum, with a chromium-free aqueous solution before the application of a paint or adhesive.

The application of conversion layers is industrially employed on a large scale for the preparation of metal surfaces for a subsequent application of paint. The conversion layers thus formed result, inter alia, in an improved adhesion of the paint films on the metals, an increased resistance to corrosion and an inhibition of subsurface corrosion which might be initiated at damaged portions of the paint film. The conversion layers are those known as phosphate layers, those formed by an alkaline solution which contains at least two different polyvalent metal ions and those formed using a solution based on titanium, zirconium and/or hafnium ions. The protective properties of the conversion layers may further be improved by a passivating postrinsing with an aqueous fluid.

Desirable properties from the aspect of application technology are obtained from a passivating postrinsing with fluids which contain hexavalent and/or trivalent chromium. However, toxicity of the trivalent and particularly of the hexavalent chromium compounds is often regarded as a disadvantage.

U.S. Pat. No. 4,376,000 describes a chromium-free postrinsing agent which contains a comparatively high concentration of polyvinylphenol. The use of this agent results in an undesired pollution of the sewage, particularly because a large amount of oxygen is required for the decomposition.

U.S. Pat. No. 3,695,942 discloses the use of soluble zirconium components for an aftertreatment of conversion layers. In addition to zirconium, the postrinsing agents contain cations consisting of alkali and ammonium. The reference contains an explicit warning against the use of alkaline earth metal cations. These postrinsing agents, which are used at a pH value from 3 to 8.5, do not result in the same quality as the chromium-containing agents.

U.S. Pat. No.3,895,970 describes acid aqueous postrinsing agents for treating phosphate layers. Such agents containing simple or complex fluorides and chromium-zirconium fluoride and zirconium fluoride are mentioned as zirconium compounds. With the exception of chromium-zirconium fluoride, the products mentioned in that patent will meet only medium requirements. Chromium-zirconium fluoride has the above-mentioned disadvantage that it is toxic.

A process for producing a conversion layer on a surface of zinc or zinc alloy followed in a subsequent stage by rinsing with a rinsing solution is known from DE-C-1 521 854 in particular as a pretreatment prior to a paint coating or film coating procedure.

In order to form a layer on a zinc or zinc alloy surface, the process known from DE-C-1 521 854 makes use of an aqueous alkaline solution which contains ions of one or more of the metals silver, magnesium, cadmium, aluminum, tin, titanium, antimony, molybdenum, chromium, cerium, tungsten, manganese, cobalt, iron and nickel as so-called non-alkaline metal ions. Solutions which contain ions of iron or cobalt with one or more of the listed metals as ions are considered to be particularly suitable. Moreover, the solutions contain organic complex former in a sufficient amount so as to maintain the non-alkaline metal ions in solution. The conversion layers formed by means of these ions have increased corrosion resistance and improved adherence of subsequently applied organic coatings. The metal surfaces on which the conversion layers are formed show improved corrosion resistance and adherence when rinsed with a solution containing an acid, hexavalent chromium and, optionally, additional trivalent chromium.

Although that process for producing a conversion layer on a zinc or zinc alloy surface provides good corrosion protection and paint adherence, the use of tri- and, in particular, hexavalent chromium ions in a passivating rinsing solution is disadvantageous due to the toxicity and the necessary special waste disposal of the hexavalent chromium (chromate detoxification).

Industrial production of conversion layers on aluminum or aluminum alloy surfaces, in particular as a pretreatment prior the application of an organic coating, also is practiced extensively. Conversion layers of this kind prevent or inhibit corrosion, and in case of an organic coating, provide an improved adherence of the applied coating. Well known chromating layers meet these requirements to a sufficient extent. However, for hygienic reasons at the work place, for reasons of environmental protection, and since the treated material is used for special purposes such as the packing of foods, the production of chromium-free conversion layers is increasingly preferred. The treatment solutions used for this purpose are generally adjusted to an acid pH value and contain, for example, titanium, fluoride, phosphate and tannin (U.S. Pat. No. 4,017,334) or zirconium, fluoride, and boron (U.S. Pat. No. 3,964,936). A treatment solution containing hafnium and fluoride is described in FR 2,417,537.

THE INVENTION

An object of the present invention is to provide a composition and method for the passivating postrinsing of conversion layers on metals before application of a paint or adhesive without the disadvantages of the known processes while providing a high protection against corrosion and a strong adhesion to paint and adhesive with little or no adverse environmental consequence.

It is another object of the invention to provide a process for the production of conversion layers on surfaces of zinc or zinc alloys wherein the disadvantages of the known process are avoided, and, in particular, which are not or only minimally harmful to the environment, and which exhibits at least the same good qualities with respect to corrosion protection and paint adherence.

It is another object of the invention to provide a process for the passivating rinsing of chromium-free conversion layers on aluminum or aluminum alloy surfaces which, with respect to the waste water treatment, does not involve the disadvantage of rinsing solutions with organic components but still does improve corrosion protection and paint adherence to at least the same degree.

These objects are accomplished in that a metal surface on which a conversion layer has been formed is rinsed with an aqueous solution which has a pH value of less than or equal to 5, preferably 3 to 5, and which contains an aluminum fluorozirconate. The aqueous solution Al:Zr:F mole ratio is (0.15 to 8.0):1:(5 to 52), preferably (0.15 to 2.0):1:(5 to 16) and most preferably (0.15 to 0.67):1:(5 to 7). The total concentration of Al+Zr+F is from 0.1 to 8.0 g/l.

Prior to application of a conversion layer, the metal surfaces to be treated should be smooth and to a large extent free of grease. Optionally, prior to the conversion treatment, they are cleaned with an alkaline, neutral or acid agent followed by a water rinse.

The invention is suitable for treating phosphate layers of all types which can be formed on metals, particularly on steel, galvanized steel, steel plated with a zinc alloy, aluminum-plated steel, zinc, zinc alloys, aluminum and aluminum alloys. Such phosphates include, inter alia, zinc phosphate, iron phosphate, manganese phosphate, calcium phosphate, magnesium phosphate, nickel phosphate, cobalt phosphate, zinc-iron phosphate, zinc-manganese phosphate, zinc-calcium phosphate, and layers of other types, which contain two or more divalent cations. The process is particularly suitable for treating those phosphate layers formed by low-zinc phosphating processes with or without the addition of other cations, such as Mn, Ni, Co, and Mg.

After the metal surface has been phosphated, it is suitably rinsed with water before being aftertreated in accordance with the invention. The aftertreating can be by various techniques such as dipping, spraying, flooding or rolling.

In another preferred embodiment of the invention the phosphated metal surface is finally rinsed with deionized water.

When the metal surface has a phosphate conversion coating, the aqueous rinse solution has a Al:Zr:F mole ratio of (0.15 to 0.67):1:(5 to 7) and a total concentration of Al+Zr+F of from 0.1 to 2.0 g/l. In a preferred embodiment of the invention, the phosphated metal surfaces are rinsed with an aqueous solution in which the total concentration of Al+Zr+F is 0.2 to 0.8 g/l.

The composition and process according to the invention are used to prepare the phosphated metal surfaces for an application of paint or adhesive. The process improves the adhesion of the organic films to the metallic substrate, the resistance of the organic films to a formation of blisters under corrosive conditions, and inhibits the progress of subsurface corrosion from damaged portions of the film. The process has proved to be particularly advantageous in conjunction with paints applied by cathodic electrocoating and powder coating or from low-solvent high-solids paints and paints applied mainly with water as a solvent.

The invention is also suitable for all surfaces containing zinc or zinc alloys, for example, materials made of massive zinc or massive zinc alloys as well as for those where the surface has been plated with zinc or zinc alloy either electrolytically or by precipitation from the gaseous phase or by means of hot-dip galvanizing. Particularly suitable alloy partners of zinc are aluminum, silicon, lead, iron, nickel, cobalt, and manganese. The zinc or zinc alloy plating can be applied to either one or both sides of planar workpieces.

The invention is also suitable for the passivating rinsing of conversion layers which are produced on aluminum or aluminum alloy surfaces. The materials can be made of massive aluminum or massive aluminum alloy or be objects plated therewith by means of hot-dip galvanizing. The material can be steel, for example, which was provided with an aluminum or aluminum alloy surface by means of hot-dip galvanizing. Suitable alloy partners for aluminum are in particular silicon, manganese, magnesium, zinc, and copper. Conversion layers produced on these surfaces with solutions on the basis of Ti, Zr and/or Hf are distinguished by a layer thickness under 1 μm. The layers are partially amorphous and do not contain chromium. The treatment solutions for producing the conversion layers contain, in addition to titanium, zirconium and/or hafnium ions, additional layer-forming and/or pickling components such as fluorides, phosphates, compounds of boron, and, optionally, passivating components such as tannin. Suitable treatment solutions are described in certain of the above mentioned patent specifications.

The preceding cleaning and grease removal of the surface may be omitted when the zinc or zinc alloy surface has only a relatively small amount of grease or contaminating material on it. Instead, the addition of tensides to the same treatment solution which serves to produce the conversion layer will provide the requisite purification and grease removal. This embodiment offers the particular advantage that the entire pretreatment of the surface can be carried out in fewer stages since there is no longer a separate cleaning accompanied by corresponding water rinsing.

The alkaline solution used in the first stage for the formation of the conversion layer on the zinc or zinc alloy surface can be applied by known techniques such as spraying, immersing or flooding.

Particularly suitable alkaline solutions contain iron(III)-ions and, in addition, cobalt- and/or nickel- and/or chromium(III)- and/or aluminum ions where the total polyvalent metal ion content is between 0.3 and 3 g/l, preferably between 0.4 and 1.2 g/l. The polyvalent metal ions can be used in the form of salts of inorganic acids, e.g. the salt of nitric acid, or in the form of salts of organic acids, e.g. formic acid, and particularly also acetic acid. Salts of organic acids which, at the same time, can serve as complex formers are also suitable. Amphoteric metals, e.g., aluminum, can be dissolved in the form of the hydroxy complex even without additional anion and/or complex former.

Due to the pickling action during the treatment in the first stage, it is possible that several polyvalent cations, which were present in the surface to be treated and not contained in the newly prepared solution, escape from the zinc or zinc alloy surface into the treatment solution. With reference to surfaces that were zinc-plated in a hot-dip galvanizing process, these are zinc, aluminum and lead. The total concentration of these cations can increase up to amounts of some g/l. This generally does not interfere with the formation of the conversion layer.

The solution should contain at least such an amount of complex former that the present polyvalent metal ions are completely bound in a complex manner. If the content of polyvalent metal ions then increases in the solution, the content of complex formers must also be increased. Since increasing amounts of certain complex formers, which are acidic by nature, can decrease the alkalinity of the solution, complex formers are preferably used in the form of neutral salts, in particular alkali metal salts. However, surplus amounts of complex formers do not bring additional advantages.

Various kinds of organic chelate formers can especially be used as complex former: e.g., dicarboxyl acid (malonic acid, fumaric acid, etc.); amino acids (e.g. glycine); hydroxy carboxyl acids (e.g., citric acid, gluconic acid, lactic acid); 1,3-diketones (e.g., acetyl acetone); aliphatic polyalcohols (e.g., sorbit, 1,2-ethanediol); aromatic carboxyl acids (e.g., salicylic acid, phthalic acid): amino carboxyl acids (e.g.: ethylene diamine tetraacetic acid). It is also possible to use other complex formers such as methane phosphonic acid diethanol amide.

The results are particularly favorable when the complex formers used are salts of gluconic acid, in particular hexahydroxy heptanoic acid. The content of complex formers in the solution should range from 0.05 to 10 g/l, in most applications between 1.5 and 5.5 g/l (referred to the sodium salt of the hexahydroxy heptanoic acid).

The aqueous solution for forming the conversion coating on the zinc or zinc alloy surface must have a pH value $\geqq 11$. The best results are obtained at a pH range between 12.2 and 13.3. The pH value can be adjusted, for example, by the addition of triethanol amine, alkali hydroxide, alkali carbonate, alkali phosphate, alkali polyphosphate, alkali pyrophosphate, alkali borate, alkali silicate or mixtures thereof. The most advantageous, however, are alkali hydroxides, in particular sodium hydroxide.

Principally, the temperature of the solution in the first stage can range from 20° C. to 90° C. The preferred temperature range is 45° to 65° C.

The treatment period usually ranges from 2 to 60 seconds, and is preferably from 5 to 30 seconds. The period depends, upon among other factors, the application technique used. The treatment period in a spraying process, for example, is shorter than in an immersion process while all other conditions remain the same.

Generally, solutions with a lower metal ion concentration require higher temperatures and longer treatment periods as compared to those with a higher metal ion concentration.

After the conversion layer has been produced, any surplus treatment solution should be removed from the zinc or zinc alloy surface as far as possible. This can be done, for example, by drip-drying, squeezing, draining or rinsing with water or an aqueous solution which is adjusted to be acidic, for example, with an inorganic or organic acid, (hydrofluoric acid, boric acid, nitric acid, formic acid, acetic acid, etc.).

After formation of the conversion layer, the so treated metal surface is subjected to a rinsing step. In a preferred embodiment of the invention, the rinse solution contains aluminum, zirconium and fluoride in a total concentration of Al+Zr+F of from 0.1 to 8 g/l, preferably from 0.2 to 5 g/l. Advantageously, the mole ratios of Al:Zr:F should be adjusted to (0.15 to 8):1:(5 to 52), in particular (0.15 to 2.0):1:(5 to 16). In a particularly preferred embodiment the Al:Zr:F mole ratio in the rinsing solution is (0.15 to 0.67):1:(5 to 7). Corresponding to another advantageous embodiment of the invention, the pH value is adjusted to 2 to 5.

The rinsing solution of the invention contains, inter alia, acid aluminum fluorozirconate, and in case there is surplus aluminum, additional other salts of aluminum (e.g., fluorides, tetrafluoroborates, nitrates).

After the passivating rinsing, the rinsed surface optionally can be rinsed with completely salt-free water. Subsequently, the surface can be dried for example in air or in a furnace. In a preferred embodiment of the invention, the drying of the surface after the passivating rinsing is accomplished by means of, for example, hot air or infrared radiation.

First and foremost, the process in accordance with the invention serves to prepare zinc or zinc alloy surfaces prior to the application of a paint coating, a film coating or the application of adhesive agents. Practice of the invention increases the adherence of organic films on the metallic background, improves resistance to bubble formation when exposed to corrosion, and inhibits the progressive formation of corrosion beginning at damage spots in the film.

When rinsing conversion layers on surfaces of aluminum or aluminum alloys on the basis of titanium, zirconium and/or hafnium, the rinse solution contains aluminum, zirconium and fluoride in a total concentration of Al+Zr+F of from 0.1 to 8 g/l, preferably 0.2 to 5 g/l. Advantageously, the mol ratios of Al:Zr:F should be adjusted to (0.15 to 8):1:(5 to 52), in particular (0.15 to 2.0):1:(5 to 16). In a most preferred embodiment of the process, the Al:Zr:F ratio in the rinsing solution is (0.15 to 0.67):1:(5 to 7). Corresponding to another advantageous embodiment of the invention, the pH value is adjusted to 2 to 5.

After the passivating rinsing, the surface can be rinsed with salt-free water and dried as described above.

The invention serves as a pretreatment of the aluminum or aluminum alloy surfaces prior to the application of a paint coating, film coating or the application of adhesive agents. The organic coating agents used are, for example, polyester, silicon modified polyesters, polyvinylidene fluorides, acrylates, epoxides, epoxy-phenol resins, plastisols or organosols (e.g., of PVC or acrylates).

An advantage of the process in accordance with the invention is in particular the increased adherence of the organic films to the metallic background. This manifests itself in good results in the T-Bend-Test (ISO 1519-1973) or in the feathering test (paint adherence when opening can closures). The corrosion resistance of the organic films also is increased, e.g., in a condensing water-constant climate test (DIN 50 017 KK) or in a sterilization test. Moreover, the invention improves the corrosion resistance of the non-organically coated surface, as can be understood from tests for well water blackness (no blackening during boiling in water).

The postrinsing agent of the invention may be chemically classified as a weakly acidic aluminum fluorozirconate. The agent may be produced, e.g., in a process in which metallic zirconium or zirconium carbonate is dissolved in aqueous hydrofluoric acid so that a complex fluorozirconic acid is formed. Then, metallic aluminum or aluminum hydroxide or an aluminum salt, preferably in a solubilized form, is added and, optionally, dissolved. The aluminum salt may be, e.g., a nitrate, fluoride, tetrafluoroborate, formate or acetate. A possible slight turbid appearance of the solution does not affect the efficiency. Although the described method of production is preferred, it is also possible to prepare the solutions in any other manner.

In another preferred embodiment of the invention the metal surface on which the conversion coating has been formed is rinsed with an aqueous solution which additionally contains at least one of the anions benzoate, caprylate, ethyl hexoate and salicylate in a total concentration of 0.05 to 0.5 g/l. This embodiment will particularly result in a greater increase of the bare corrosion protection. The anions may be added as the corresponding acids or salts.

The pH value of the postrinsing solution is preferably adjusted with cations of one or more volatile bases, which particularly include ammonium, ethanolammonium and di- and triethanolammonium. When higher pH values are adjusted in the indicated pH range and when the concentration in the indicated range of the total concentration of Al+Zr+F is higher, the solution turns cloudy. This, however, has no negative effect on the efficiency of the process.

The passivating postrinsing fluid may be applied to the conversion layer metal surfaces by dipping, flooding, spraying and wetting or rolling, e.g., by means of rollers. The treating times are between about 1 second and 2 minutes particularly 1 to 30 seconds. The fluid may be applied at a temperature from room temperature to about 80° C. Temperatures of 20° to 50° C. are usually preferred.

Deionized or low-salt water is usually employed to prepare the postrinsing baths. Water having a high salt content is less suitable for preparing the baths.

The invention will be further explained and illustrated in detail by way of reference to the following Examples.

EXAMPLE 1

Degreased sheets made of steel, electrogalvanized steel and AlMgSi are sprayed in a manganese-modified low-zinc phosphating process at 55° C. for 2 minutes. The phosphating solution had the following composition:

| | |
|---|---|
| 0.7 g/l Zn | 0.04 g/l Fe(III) |
| 1.0 g/l Mn | 13 g/l $P_2O_5$ |
| 1.0 g/l Ni | 2.1 g/l $NO_3$ |
| 2.9 g/l Na | 0.3 g/l F |
| 0.15 g/l $NH_4$ | 0.07 g/l $NO_2$ |

Finely crystalline, uniformly covering phosphate layers weighing 2.5 to 3 g/m$^2$ were formed on the three metal substrates. Thereafter the sheets were rinsed with water and then subjected to a passivating postrinse. The passivating postrinsing was effected by spraying at 30° C. for 1 minute. Thereafter the sheets were rinsed with deionized water and were coated with a primer applied by cathodic electrocoating with a filler and with a top coat. Each paint film was separately baked. The total thickness of the coating amounted to 90 μm.

The sheets were subsequently scribed by means of a steel needle as far as to the metal substrate and were then subjected to various tests. The results are compiled in Tables 1 to 3.

To prepare the postrinsing fluid of the invention, 1.6 g of an aqueous concentrate containing 0.855% Al+8.62% Zr+10.7% F was diluted with deionized water and was subsequently adjusted with ammonia to a pH value of 3.5 to 4.0. This resulted in a postrinsing fluid containing 0.014 g/l Al+0.14 g/l Zr+0.17 g/l F+0.026 g/l $NH_3$.

Control tests were conducted with: A postrinsing solution containing Cr(VI) and Cr(III), specifically 0.2 g/l $CrO_3$ and 0.037 g/l Cr(III), and having a pH value of 3.5 to 4.0; a solution of chromium fluorozirconate containing 0.047 g/l Cr(III), 0.083 g/l Zr and 0.121 g/l F and having a pH value of 3.5 to 4.0; and a solution containing 0.6 g/l polyvinylphenol and having a pH value of 3.5 to 4.0.

Each sheet specimen was tested by the salt spray test in accordance with DIN 50021 SS(1008 h), the Filiform Test in accordance with ASTM D 2803 (1008 h) and 20 cycles of the General Motors Test Method TM 54-26 (GM Scab Test). The subsurface corrosion under the organic coating (rate of creep back) was measured in mm.

TABLE 1

| | | Results on Steel | | |
|---|---|---|---|---|
| | | Subsurface corrosion under organic coating (mm) in | | |
| After-rinsing agent | pH-value | Salt spray test DIN 50021 SS (1008 h) | Filiform Test ASTM D 2803 (1008 h) | GM Scab Test (20 cycles) |
| Cr(VI)-Cr(III) | 3.5-4.0 | 0-<1 | 0 | 3.5 |
| Chromium fluoro-zirconate | 3.5-4.0 | 0-<1 | 0-<1 | 3.5 |
| Polyvinyl-phenol | 3.5-4.0 | 0-1 | <1 | 4.0 |
| Aluminum fluoro-zirconate + $NH_3$ to pH (invention) | 3.5-4.0 | 0 | 0 | 3.5 |

TABLE 2

| | | Results on Galvanized Steel | | |
|---|---|---|---|---|
| | | Subsurface corrosion under organic coating (mm) in | | |
| After-rinsing agent | pH-value | Salt spray test DIN 50021 SS (1008 h) | Filiform Test ASTM D 2803 (1008 h) | GM Scab Test (20 cycles) |
| Cr(VI)-Cr(III) | 3.5-4.0 | 8.5 | 0 | <1-1 |
| Chromium fluoro-zirconate | 3.5-4.0 | 7.0 | 0-<1 | <1-1 |
| Polyvinyl-phenol | 3.5-4.0 | 6.5 | 0-<1 | 1 |
| Aluminum fluoro-zirconate + $NH_3$ to pH (invention) | 3.5-4.0 | 5.5 | 0 | <1-1 |

TABLE 3

| | | Results on AlMgSi | | |
|---|---|---|---|---|
| | | Subsurface corrosion under organic coating (mm) in | | |
| After-rinsing agent | pH-value | Salt spray test DIN 50021 SS (1008 h) | Filiform Test ASTM D 2803 (1008 h) | GM Scab Test (20 cycles) |
| Cr(VI)-Cr(III) | 3.5-4.0 | <1 | 0 | 0.5-1 |
| Chromium fluoro-zirconate | 3.5-4.0 | 0 | 0 | 1 |
| Polyvinyl-phenol | 3.5-4.0 | 0-<1 | 0 | 1 |
| Aluminum fluoro-zirconate + $NH_3$ to pH (invention) | 3.5-4.0 | 0 | 0 | 0.5-1 |

A comparison of the data compiled in Tables 1 to 3 shows the results obtained by the invention are at least as good in each case as the best of the three controls which were also tested.

EXAMPLE 2

In order to produce the conversion layer, cleaned and degreased sheets of metal made of hot galvanized steel were immersed in an alkaline solution of polyvalent metal ions for 30 seconds. The solution was at a temperature of 55° C., and had the following composition:

| | |
|---|---|
| $Co^{2+}$ | 0.3 g/l |
| $Fe^{3+}$ | 0.2 g/l |
| $NO_3-$ | 1.3 g/l |
| Sodium salt of the hexahydroxyheptanoic acid | 2.2 g/l |
| NaOH | 27.4 g/l |

The sheets of metal were then rinsed with water and rinsed again in a passivating manner. For this purpose, the metal sheets were immersed in the rinsing solution for a period of 5 seconds and any surplus solution was removed by squeezing. After a drying period of 0.5 min in a forced-air oven at 75° C., the paint coating with an epoxy primer and an acrylate covering paint layer were applied to the pretreated sheet metals. The total thickness of the paint layer was approximately 25 μm.

Subsequently, the treated sheets of metal were subject to the following tests:

The adherence of the paint was determined in a T-Bend-test where the pieces of sheet metal were bent by 180°. The various radii of the curvature (Tn) were indicated as an n-fold value of the sheet metal thickness (n=0, 1, 2, . . .). The percentage of the painted surface that came off of the entire cured surface was given as the tested value.

On other pieces of treated sheet metal, a scratch penetrating down to the metal base was created by means of a pin, and a cut was inserted by means of metal shears. The sheet metal was then subject to a salt spraying test according to DIN 50021 SS for a period of 1008 hours. The indicated tested value was how far the coat of paint was affected (mm) beginning at the scratch and/or the cutting edge.

The rinsing solutions used were produced by dilution of 1.6 g/l (rinsing solution A) and/or 20 g/l (rinsing solution B) of an aqueous concentrate with 0.855 wt.-% Al and 8.62 wt.-% Zr and 10.7 wt.-% F using completely salt-free water. The pH value in both solutions was adjusted to approximately 3.6 using ammonia.

A rinsing solution (rinsing solution C) containing Cr(VI) and/or Cr(III) with a pH value of approximately 3.3 was used for comparison. The compositions of the rinsing solutions were:

| | |
|---|---|
| Rinsing Solution A: | |
| Al | 0.014 g/l |
| Zr | 0.14 g/l |
| F | 0.17 g/l |
| $NH_4$ | 0.016 g/l |
| Rinsing Solution B: | |
| Al | 0.17 g/l |
| Zr | 1.72 g/l |
| F | 2.14 g/l |
| $NH_4$ | 0.40 g/l |
| Rinsing Solution C: | |
| $Cr^{6+}$ | 2.0 g/l |
| $Cr^{3+}$ | 0.8 g/l |
| F | 0.2 g/l |
| Zn | 0.3 g/l |

Tables 4 and 5 reflect the test results.

TABLE 4

Paint Adherence in T-Bend-Test

| Rinsing solution | Surface area (%) chipped off at curvature radius Tn | | | |
|---|---|---|---|---|
| | T1 | T2 | T3 | T4 |
| A (Invention) | 100 | 55 | 15 | 5 |
| B (Invention) | 100 | 65 | 25 | 5 |
| C (Comparison) | 100 | 80 | 30 | 5 |

TABLE 5

Corrosion Resistance in Salt Spraying Test

| Rinsing solution | Progression (mm) after 1008 hours | |
|---|---|---|
| | At scratch | at cutting edge |
| A (Invention) | <1-1 | 8-9 |
| B (Invention) | 0-1 | 7 |
| C (Comparison) | 1-3 | 9-10 |

A comparison of the values of Tables 4 and 5 shows that the invention provides values that are at least as good, if not better, than those obtained with a rinsing solution on the basis of Cr(VI)/Cr(III).

EXAMPLE 3

In order to produce the conversion layer, cleaned and degreased aluminum sheet metal, was immersed in a solution for 10 seconds. The solution was at a temperature of 50° C. and had the following composition:

| | |
|---|---|
| Ti | 0.17 g/l |
| F | 1.24 g/l |
| $P_2O_5$ | 0.09 g/l |
| $NH_4$ | 0.91 g/l |
| Tannin | 0.11 g/l |
| Na | 0.003 g/l |
| Biozid | 0.10 g/l |

Then the sheets of metal were first rinsed with water and then rinsed again in a passivating manner. For this purpose the sheets of metal were immersed into the rinsing solution for 5 seconds and then surplus solution was removed by squeezing. After a drying period of 0.5 minutes in a forced air oven at 60° C., a two-layer food paint coating was applied onto the sheet metals with the first layer being a layer of epoxyphenol resin and the second layer consisting of organosol. The total thickness of the layers was between 10 and 15 μm.

Subsequently round pieces having a diameter of 60 mm and a thickness of 0.25 mm were stamped out of these sheet metal pieces and deep drawn in cups having a diameter of 26 mm and a height of 25 mm.

These cups were then subject to a sterilizing test where, in a pressurized vessel, they were exposed for a period of 40 minutes to the action of an aqueous solution consisting of 3% salt, 1% citric acid, and 0.5% lactic acid at a temperature of 121° C. The defects (paint removal, bubbles) which were found at the cups were then evaluated according to a scale of 1 (paint layer removed in the entire coating area of the cup=useless) to 15 (no paint defects=excellent).

The rinsing solutions used were rinsing Solution A and rinsing Solution C. The latter solution as prepared by diluting 3.2 g/l of an aqueous concentrate with 0.855 wt.-% Al and 8.62 wt.-% Zr and 10.7 wt.-% F using completely salt-free water. In both solutions, the pH value was adjusted to approximately 3.6 using ammonia.

For a comparison, a rinsing was carried out with a polyvinylphenol solution with 0.6 g/l and a pH value of approximately 5 (rinsing solution D).

The composition of the rinsing solution used in the process of the invention was as follows:

| Rinsing Solution A: | | Rinsing Solution C: | |
|---|---|---|---|
| Al | 0.014 g/l | Al | 0.028 g/l |
| Zr | 0.14 g/l | Zr | 0.28 g/l |
| F | 0.17 g/l | F | 0.34 g/l |
| $NH_4$ | 0.016 g/l | $NH_4$ | 0.03 g/l |

Results of the Sterilization Tests
(Evaluating scale: 1 = useless to 15 = excellent)

| Rinsing Solution | Evaluation |
|---|---|
| A (Invention) | 11 |
| C (Invention) | 10 |
| D (Comparison) | 6 |

A comparison of the values obtained from the Sterilization Tests shows that the invention provides substantially improved values over the polyvinylphenol rinsing solution.

It will be understood that the specification and examples are illustrative but not limitative of the present invention and that other embodiments within the spirit and scope of the invention will suggest themselves to those skilled in the art.

We claim:

1. A process for passivating postrinsing a phosphate conversion layer on a metal surface with a chromium-free aqueous rinsing solution before the application of a paint or adhesive, comprising rinsing the phosphated metal surface with an aqueous rinsing solution of an aluminum fluorozirconate having an Al:Zr:F mole ratio of (0.15 to 0.67):1:(5 to 7), the solution having a pH value of 3 to 5 and a total concentration of Al+Zr+F of 0.1 and 2.0 g/l.

2. The process of claim 1 wherein the metal surface is steel, galvanized steel, zinc alloy-plated steel or aluminum.

3. The process of claim 1 wherein the rinsing solution contains anions of at least one of benzoate, caprylate, ethylhexoate, and salicylate in a total concentration of 0.05 to 0.5 g/l.

4. The process of claim 1 wherein the pH of the aqueous solution is adjusted with cations of a volatile base.

5. The process of claim 4 wherein the volatile base is at least one base selected from the group consisting of ammonium, ethanolammonium, di- and triethanolammonium.

6. The process of claim 1 wherein the total concentration of Al+Zr+F is 0.2 to 0.8 g/l.

7. A process of treating a metal surface comprising:

forming a conversion layer on the metal surface by contacting the metal surface with an aqueous solution containing conversion layer forming constituents; and rinsing the metal surface on which the conversion layer has been formed with an aqueous rinsing solution of an aluminum fluorozirconate having an Al:Zr:F mole ratio of (0.15 to 8.0):1:(5 to 52), a total concentration of Al+Zr+F of from 0.1 to 8.0 g/l, and a pH value≦5.

8. The process of claim 7 wherein the Al:Zr:F mole ratio is (0.15 to 2.0):1:(5 to 16).

9. The process of claim 7 wherein the total concentration of Al+Zr+F is 0.2 to 5.0 g/l.

10. The process of claim 7 wherein the pH is 2 to 5.

11. The process of claim 7 wherein the metal surface is of zinc or zinc alloy and the aqueous solution for forming the conversion layer contains at least two different polyvalent metal ions and a complex former in such an amount as to maintain the polyvalent metal ions in solution, said solution having a pH value≧11.

12. The process of claim 11 wherein the pH value is between 12.2 and 13.3.

13. The process of claim 7 wherein the pH of the aqueous rinsing solution is adjusted with cations of a volatile base.

14. The process of claim 13 wherein the volatile base is at least one base selected from the group consisting of ammonium, ethanolammonium, di- and triethanolammonium.

15. The process of claim 7 wherein the rinsing solution contains anions of at least one of benzoate, caprylate, ethylhexoate, and salicylate in a total concentration of 0.05 to 0.5 g/l.

16. The process of claim 7 wherein the metal surface is of aluminum or aluminum alloy and the aqueous solution for forming said conversion layer is based on titanium, zirconium and/or hafnium ions.

17. The process of claim 7 wherein the metal surface is of zinc, zinc alloy, aluminum or aluminum alloy and the aqueous rinse solution has a mole ratio of Al:Zr:F of (0.15 to 0.67):1:(5 to 7) and a pH of 2 to 5.

18. The process of claim 7 wherein the aqueous rinsing solution is chromium free.

* * * * *